US008530808B2

(12) United States Patent
McArdle

(10) Patent No.: US 8,530,808 B2
(45) Date of Patent: Sep. 10, 2013

(54) MICROWAVE-ASSISTED HEATING AND PROCESSING TECHNIQUES

(75) Inventor: Phillip Michael McArdle, Manchester, CT (US)

(73) Assignee: Energy Beam Sciences, Inc., East Granby, CT (US)

( * ) Notice: Subject to any disclaimer, the term of this patent is extended or adjusted under 35 U.S.C. 154(b) by 1045 days.

(21) Appl. No.: 11/517,709

(22) Filed: Sep. 8, 2006

(65) Prior Publication Data

US 2008/0064085 A1 Mar. 13, 2008

(51) Int. Cl.
*H05B 6/64* (2006.01)

(52) U.S. Cl.
USPC ..... 219/759; 219/634; 219/678; 219/702; 219/730; 422/21; 422/33; 422/36; 422/40

(58) Field of Classification Search
USPC ..... 422/21, 33, 36, 40; 219/678, 702, 219/730, 756, 759
See application file for complete search history.

(56) References Cited

U.S. PATENT DOCUMENTS 4,518,651 A * 5/1985 Wolfe, Jr. ..... 428/308.8
4,851,632 A * 7/1989 Kaliski ..... 219/730
4,904,836 A * 2/1990 Turpin et al. ..... 219/759
5,021,293 A 6/1991 Huang et al.
5,068,086 A * 11/1991 Sklenak et al. ..... 435/40.5
5,884,006 A * 3/1999 Frohlich et al. ..... 392/339
6,372,512 B1 * 4/2002 Kerschmann ..... 436/174
6,632,598 B1 * 10/2003 Zhang et al. ..... 435/4
6,793,890 B2 9/2004 Morales et al.
7,075,045 B2 * 7/2006 Visinoni ..... 219/685

OTHER PUBLICATIONS

L. P. Kok et al., Microwaves for the Art of Microscopy; Coulomb Press Leyden; Chapter 4, p. 27-59 (2003).

Histotechniques; http://www-medlib.med.utah.edu/WebPath/HISTHTML/HISTOTCH/HISTOTCH.html; (<Aug. 21, 2006).

Klump, Vincent R., Jr.; Working Procedures in Microwave Histology; Energy Beam Sciences; http://www.ebsciences.com/papaers/microwave.htm; (<Aug. 21, 2006).

* cited by examiner

*Primary Examiner* — Melanie Y Brown
*Assistant Examiner* — Erik B Crawford
(74) *Attorney, Agent, or Firm* — Anthony L. Miele

(57) ABSTRACT

Apparatus are provided which include a specimen vessel holding at least one biological sample. A histological agent is in the specimen vessel so as to come into contact with the tissue sample. A microwave susceptor is provided in, near, or integral to the specimen vessel.

33 Claims, 3 Drawing Sheets

MICROWAVE-ASSISTED HEATING AND PROCESSING TECHNIQUES

FIELD OF THE DISCLOSURE

Aspects of the disclosure are related to processes and apparatus for processing tissue, e.g., histological processing.

DESCRIPTION OF BACKGROUND INFORMATION

Histological tissue processing is an important part of many different medical and forensic situations. The processing is performed in order to create stained cellular structures on a microscope slide for subsequent study and analysis using a microscope. By way of example, a doctor may perform a biopsy, and remove a small sample of tissue from a patient. This tissue is then placed into a small container of preservative, i.e., a fixative. At the lab, a histotech removes the specimen from the fixative, and places it into a labeled cassette.

The specimen is now processed, either traditionally (i.e., without acceleration techniques such as the use of a microwave) or via microwave processing, to produce a stained version of the tissue.

In one example of microwave tissue processing, cassettes containing formalin-fixed tissue may be place into a rack, and the rack is then placed into a Pyrex™ dish of ethyl alcohol. This is the dehydration step. In a next step, "clearing", isopropyl alcohol is applied to the tissue, which removes the remaining water, the ethyl alcohol, and fats from the tissue. In a next step, an embedding agent (e.g., Paraffin) is infiltrated and embedded into the tissue. Different agents may be used depending upon the protocol. For example, rather than use isopropyl alcohol, isoparaffinics may be used. In addition, the fixation of the tissue may be carried out by means other than with the use of formalin. For example, microwave-assisted fixation may be used with different agents such as a glyoxal fixative.

Other processing methods include, e.g., tissue processing for electron microscopy and heating or drying of slides containing specimens, to name just a few.

SUMMARY OF THE DISCLOSURE

In accordance with one aspect of the disclosure, apparatus are provided, which include a specimen vessel holding at least one biological tissue sample. A histological agent is in the specimen vessel so as to come into contact with the tissue sample. A microwave susceptor structure is provided in, near, or integral to the specimen vessel.

BRIEF DESCRIPTION OF THE DRAWINGS

Embodiments of the disclosure are further described in the detailed description which follows, by reference to the noted drawings, in which like reference numerals represent similar parts throughout the several views of the drawings, and wherein.

DETAILED DESCRIPTION

Figure 1:
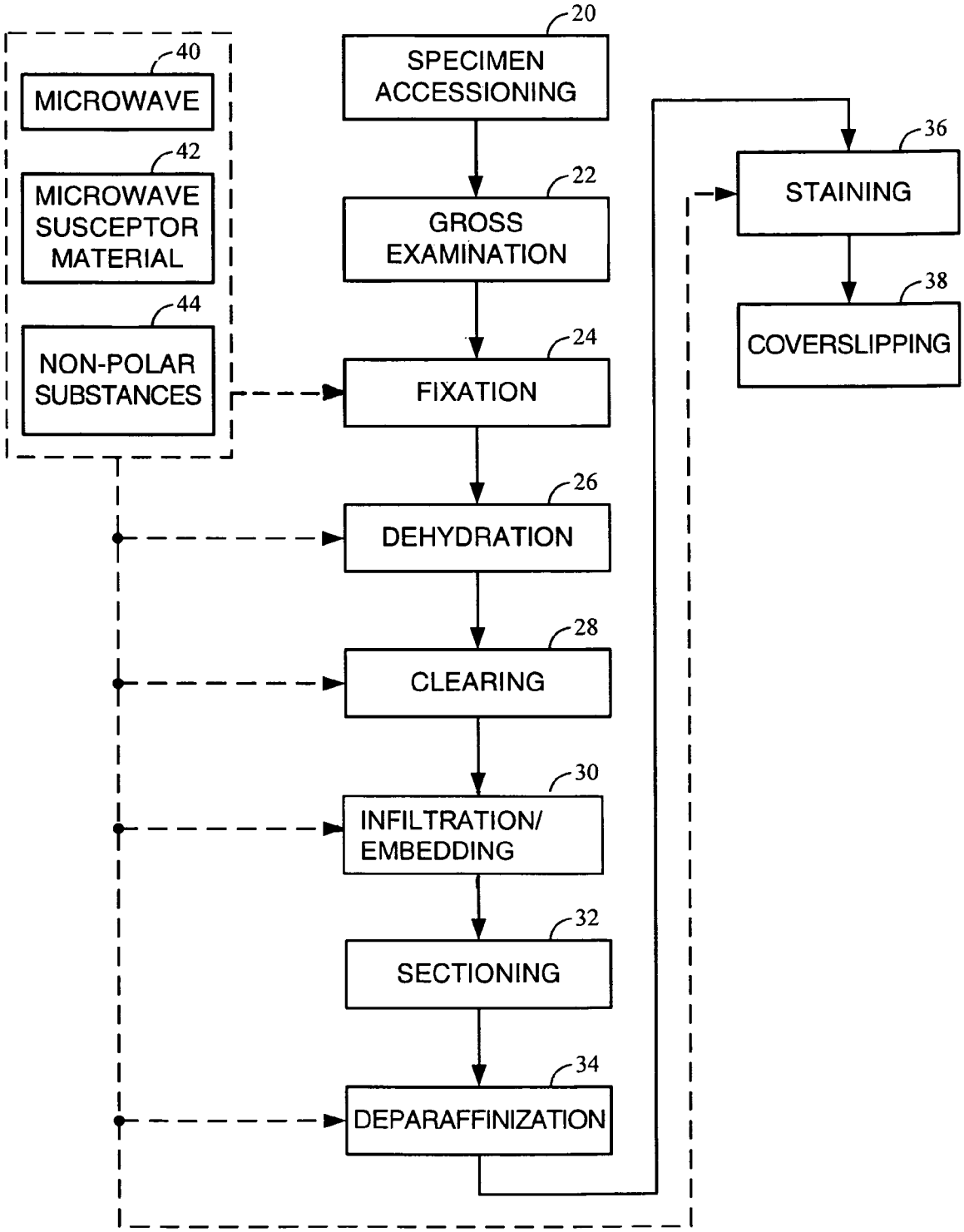
FIG. 1 is a flow diagram of various steps in a tissue processing system.

Referring now to the drawings in greater detail, FIG. 1 is a flow diagram of an example process carried out in a histological tissue processing environment. In act 20, the specimen is accessioned. At this point, specimens are given a number which will identify each specimen for each patient. In a next act 22, the tissue that has been removed from the body for diagnosis is examined, for example, by a pathologist, a pathology assistant, or a pathology resident. Gross examination may include describing the specimen and placing all or parts of the specimen into a plastic perforated cassette which holds the tissue while it is being processed.

In a next act 24, the tissue is fixed. Fixation preserves the tissue in as life-like state as possible, and should be carried out as soon as possible after the tissue is removed to prevent autolysis. Formalin (formaldehyde) is the most commonly used fixative. Other groups of fixatives include aldehydes, mercurials, alcohols, oxidizing agents, and picrates.

In act 26, the tissue is dehydrated. This may be done, for example, with a series of alcohols.

In a next act 28, the dehydrant substances are removed from the tissue. This may, for example, be done with xylene, or in the case of microwave processing, with other safer substances, such as isopropyl alcohol. After the clearing act 28, the tissue is infiltrated and embedded with an embedding agent, typically paraffin. Different types of paraffin can be used, for example, that have different melting points and different degrees of hardness. One product called paraplast contains plasticizers that make the paraffin blocks easier to cut. The infiltration and embedding process can be assisted by applying a vacuum to the container holding the tissue. The process, including dehydration at act 26, clearing at act 28, and embedding at act 30 (and also including fixation at act 24) can be automated.

Subsequent to infiltration and embedding in act 30, the tissue is sectioned at act 32, at which point the tissue is cut into sections that can be placed on a slide. This may be done with a microtome. After the sectioning, de-embedding is performed at act 34. This prepares the tissue for subsequent staining at act 36. After the tissue is stained, cover slipping is performed at act 38, at which point the stained section is covered with a thin piece of plastic or glass to protect the tissue from being scratched, and to provide better optical quality for viewing under the microscope.

As shown in FIG. 1, in the processes and systems of the present disclosure, one or more of the fixation act 24, the dehydration act 26, the clearing act 28, the infiltration and embedding act 32, the de-embedding act 34, and the staining act 36, may involve applying a microwave to the tissue during those acts. Per variations of the embodiments of this disclosure, the microwave may be used to accelerate the reaction, to control the temperature of the tissue and of reagent, to increase the temperature of the reagent (for example, in the case of infiltration and/or embedding an embedding agent into the tissue at act 30), and/or to enhance, inhibit, or otherwise affect certain biological functions of the biological tissue sample for subsequent study.

When applying a microwave to the tissue sample, if only the tissue sample and the vessel holding the tissue sample (e.g., a slide, a container, a conduit, etc.) are polar substances (i.e., they include no other polar materials, with a high dielectric constant—e.g., only paraffin), the microwave's reaction chamber may not be sufficiently attenuated. This can cause problems in the operation of the microwave oven, or it could cause damage to the biological tissue itself, which may overheat and be damaged. As shown in FIG. 1, any one or more of these acts (particularly, e.g., infiltration, embedding, de-embedding, cleaning using isoparaffinics, and slide drying) may involve the use of a microwave 40, while the polar substances 44 in the microwave reaction chamber may be limited.

Accordingly, to reduce the risk that the tissue will be damaged, a microwave susceptor material 42 may be provided in the reaction chamber to cause attenuation of the microwaves and to prevent damage to the tissue during such acts.

This material 42 is helpful, e.g., during the infiltration and embedding act 30, as well as the de-embedding act 34, at which point the only materials in the specimen batch container (other than microwave susceptor material 42), and accordingly, in the reaction chamber of the microwave, may be the tissue sample itself and paraffin (which is a non-polar substance). Should microwaves be used to heat the paraffin without the presence of susceptor material 42, to thereby liquefy the paraffin for either infiltration and embedding or for deparaffinization, the biological tissue itself could be damaged. Accordingly, microwave susceptor material 42 is provided in the microwave chamber, specifically, in certain embodiments, in the specimen batch container, to heat up the paraffin to a desired temperature while the specimen is not damaged.

Figure 2:
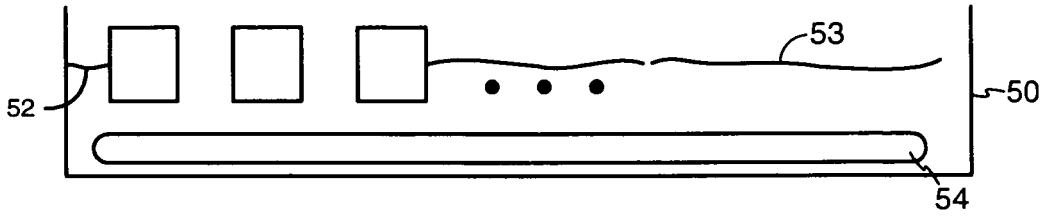
FIG. 2 illustrates a side schematic view of a specimen batch container.

FIG. 2 shows one example embodiment of a specimen batch container 50. The view shown in FIG. 2 is a schematic side view. The container may, for example, be a tray or a nine inch by nine inch Pyrex™ dish. The illustrated specimen batch container 50 includes a microwave susceptor sheet 54, which, in this illustrated embodiment, spans substantially the entire surface of the bottom of container 50. A set of specimen containers 52 is provided. In the embodiment, each container corresponds to a unitary tissue sample, and includes perforations. The containers may be, for example, cassettes with hinged covers, arranged and held by a cassette rack.

The illustrated microwave susceptor sheet 54 may comprise a microwave susceptor material or structure, and need not be a sheet. The microwave susceptor material may be configured to apply directional heat when in a microwave reaction chamber. The illustrated microwave susceptor material includes metalized film. It may be coated with a protective polyester layer. The illustrated metalized film includes aluminum, which may be in the form of aluminum flakes. Alternatively, the microwave susceptor material could comprise, for example, the material as disclosed in U.S. Pat. No. 5,021,293, or as described in U.S. Pat. Nos. 4,518,651, 4,267,420, 4,434,197, 4,190,757, 4,706,108, U.K. Patent Application No. 2,046,060A, or European Patent Application Publication No. 63,108, the content of each of which is hereby incorporated by reference herein (except that any terms as coined or defined in such references shall not affect the meaning of such terms herein or in the appended claims hereof). While each of these other materials could be, for example, used as alternatives, the use of a material having a metalized aluminum flake layer is one embodiment. Example aluminum materials are described in the detailed description of the noted U.S. Pat. No. 5,021,293.

The illustrated specimen batch container 50 shown in FIG. 2 further includes a histological agent 53. The histological agent 53, depending upon the stage within the tissue process being performed, may include one of a dehydrating agent, a clearing agent, an embedding agent, a de-embedding agent, and a staining agent. In the case of the use of microwaves to assist in the embedding or the de-embedding, i.e., as per acts 30 or 34 as shown in FIG. 1, the histological agent may include paraffin, or a type of paraffin. The paraffin is placed in the specimen batch container so as to come into contact with the tissue samples when the histological embedding agent is treated. The way it is treated is generally by heating the paraffin. In certain contexts, paraffin may be heated, for example, to 82 degrees celsius. The paraffin is liquified to facilitate infiltration and embedding of the paraffin into the tissue sample or to facilitate the de-embedding of the paraffin out of the tissue sample. A vacuum may be applied to the processing station in order to facilitate infiltration and/or embedding of the paraffin into the tissue sample.

Figure 3:
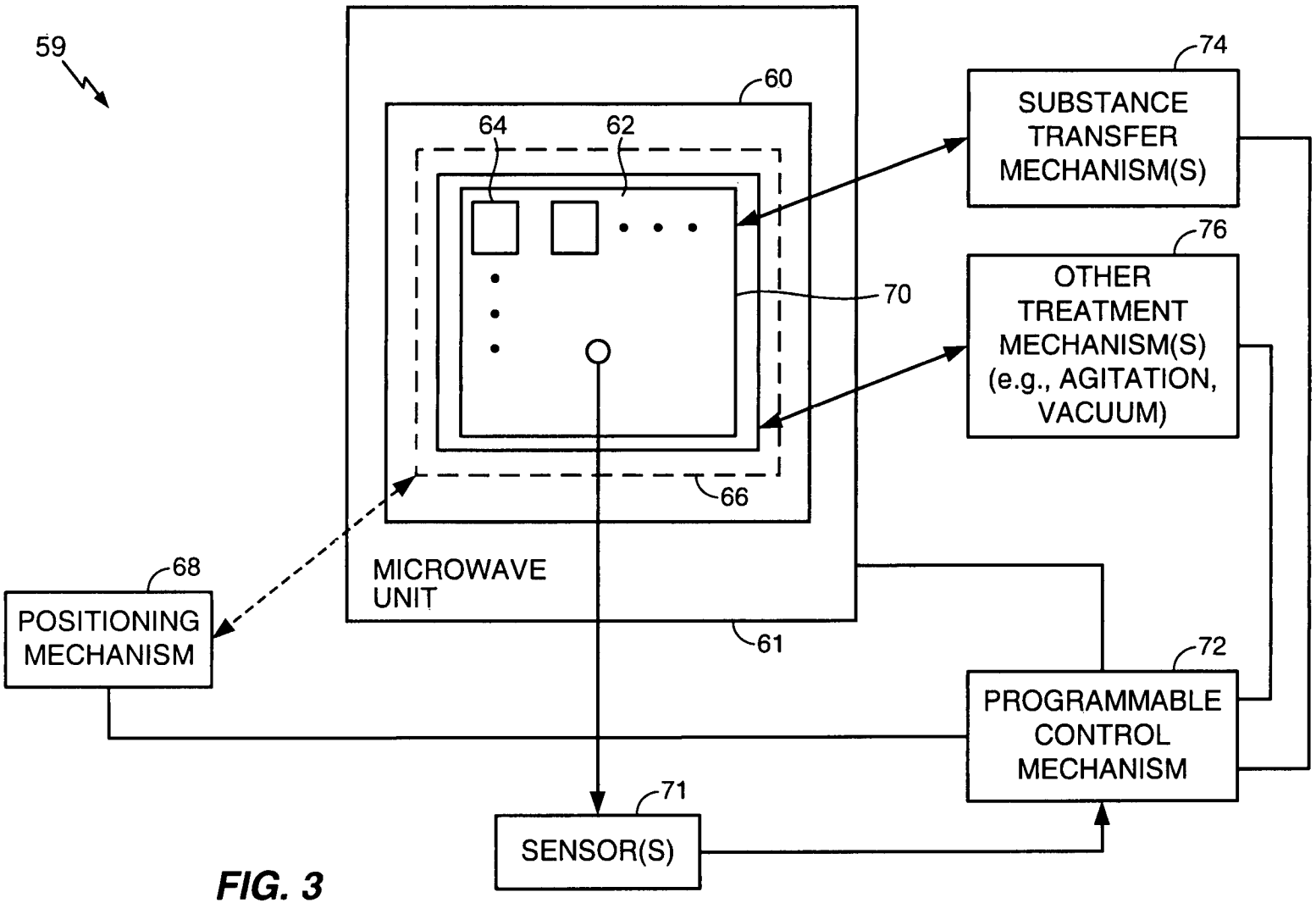
FIG. 3 is a block diagram of a tissue processing system.

FIG. 3 is a block diagram of an example tissue processing system in accordance with one embodiment of the present disclosure. The illustrated tissue processing system 59 may be a manual tissue processing system, which provides for manually carrying out one or more aspects of the tissue processing process. Alternatively, the system may be partially automated, or fully automated. The illustrated system 59 includes a station 60, at which a batch container 62 is placed. In the illustrated embodiment, there is only a single station 60, and that station is stationary and is located within the reactive chamber of a microwave unit 61. Batch container 62 includes a set of specimen containers 64, and is supported by a batch container support structure 66.

Optionally, a positioning mechanism 68 may be provided, to physically place a particular batch in a batch container 62 in station 60, to remove a given batch container 62 from station 60, and to replace or otherwise position batch containers in or out of microwave unit 61. Given that the specific example embodiment includes only a single station 60, a positioning mechanism 68 is generally not necessary.

A microwave susceptor structure 70 is provided in or as part of the structure of batch container 62. The illustrated microwave susceptor structure 70 may include a metalized layer or film. It may further include such a film laminated to a paper-based card stock. In addition, the microwave susceptor structure 70 may include such a film coated with a protective polyester layer. The metalized film may include aluminum. The microwave susceptor structure 70 is in the reaction chamber of microwave unit 61. In the illustrated embodiment, it is in the bottom of batch container 62. In the embodiments illustrated herein, microwave susceptor structure 70 is in direct or indirect contact with the histological agent that is within the batch container 62. The microwave susceptor structure 70 may be fixed to, embedded within, or integral to the structure of specimen batch container 62, or, it may be fixed to, embedded within, or integral to the structure of the specimen containers 64. Alternatively, it could be a disposable separate sheet of microwave susceptor material, e.g., placed in the bottom of batch container 62.

One or more sensors (including temperature sensors) 71 may be provided for sensing various conditions within batch container 62. For example, the temperature of substances within batch container 62 may need to be sensed in order to facilitate control of various aspects of the tissue processing techniques, which will be carried out by a programmable control mechanism 72. In the illustrated embodiment, programmable control mechanism 72 includes a computer, for example, a personal computer, which is configured (e.g., provided with software programmed) to automatically process tissue, including carrying out fixation, dehydration, clearing, and infiltration and embedding, all in the processing station 60 in the reaction chamber of microwave unit 61 without the need to move or remove the batch container 62 during or in between any of the acts of fixation, dehydration, clearing, and infiltration and embedding.

The illustrated system 59 further includes a substance transfer mechanism or a plurality of such mechanisms 74 for facilitating the transfer of substances (mainly the histological agents) into and out of batch container 62. Other treatment mechanism or mechanisms 76 may be provided for treating or acting on batch container 62. For example, a mechanism may be provided for applying an agitation to batch container 62 and/or applying a vacuum to the container. Each of substance transfer mechanism(s) 74, other treatment mechanism(s) 76, optionally provided positioning mechanism 68, sensor(s) 71, and microwave unit 61, may be connected to programmable control mechanism 72 via an interface to allow the programmable control mechanism 72 to be aware of the status and functioning of each of those subsystems as well as to send control signals and control the operation thereof.

The sensor(s) 71, programmable control mechanism 72, microwave susceptor structure 70, and microwave unit 61, together, can be configured to serve as a heat sink or temperature buffer, i.e., to maintain physiological temperatures as desired while allowing microwave stimulation of a specimen, e.g., of a living tissue sample in one embodiment. In addition, a microwave unit and susceptor material may be used to cause slide drying, and/or de-embedding (as noted above).

Figure 4:
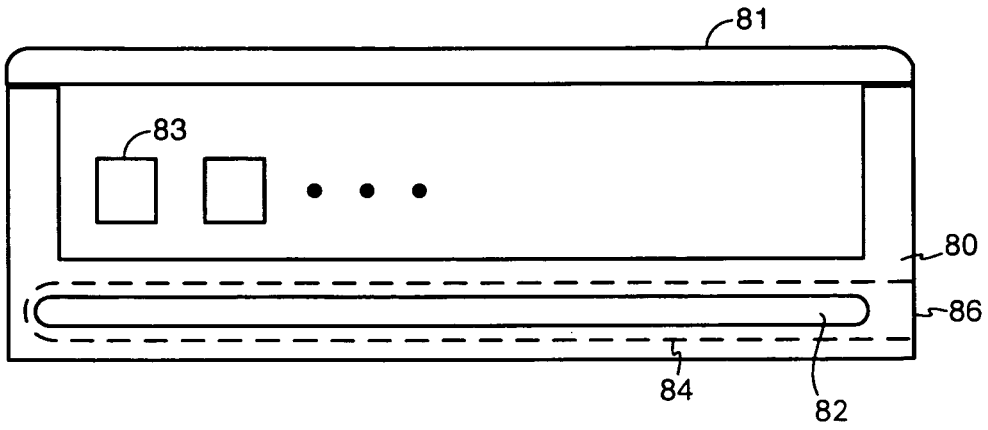
FIG. 4 is a sectional side view of another example of a processing container.

FIG. 4 is a sectional side view of a processing container 80 (a batch container as described in the previous embodiments). The illustrated processing container 80 may include a cover 81 as shown, and holds a plurality of specimen containers 83. In the bottom of container 80, a microwave susceptor structure 82 is embedded. The embedded microwave susceptor structure 82 may be permanently embedded into processing container 80, or it may be removable into and out of a recess, for example, shown as a recess 86 shown at the right hand end of the illustrated processing container 80, in the view shown in FIG. 4. Microwave susceptor structure 82 is embedded within the recess 84 provided in the bottom portion of the illustrated processing container 80.

The illustrated microwave susceptor structure 82, and/or the susceptor material 54 as shown in FIG. 2, and/or the microwave susceptor structure 70 as shown in FIG. 3, can be "tuned" by having particular patterns. For example, the structure of the susceptor could include slats, like that of a venetian blind, or overlapping radiating "spoke" patterns. The slats or spokes could be moved in order to dynamically change or tune the microwave susceptor structure.

Histological processing for electron microscopy involves steps similar to those as described above for the histological context, generally using different histological agents. For example, an embedding agent may include an epoxy resin instead of paraffin.

While certain embodiments described above include a specimen batch container containing a set of perforated specimen containers, one or more biological tissue samples may reside in, on, or otherwise be held by any specimen vessel appropriate for the circumstances. A few example specimen vessels include a container, a plate, an open fluid holder, a closed fluid holder, a slide, a conduit, a combination of any such structures, etc.

In one or more embodiments, the microwave unit may include a lab microwave with enhanced temperature control features. For example, the unit may have shorter pulse cycle times (e.g., on the order of a second, several seconds, or less per cycle), a power amplitude adjustment mechanism, and/or change controls to change, e.g., the cycle time, pulse time within a cycle, the power amplitude, and/or one or more other parameters in order to control the energy and/or heating effects of the unit on items within the chamber.

The claims as originally presented, and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. Apparatus comprising:

a specimen vessel holding at least one biological tissue sample;

a histological agent in the specimen vessel so as to come into contact with the tissue sample; and a microwave susceptor in, near, or integral to the specimen vessel, the microwave susceptor comprising a susceptor material configured and positioned in relation to the biological tissue sample so as to both absorb and attenuate given microwave field energy at a solid portion of the susceptor material as a result of the given microwave field energy passing through the solid portion of the susceptor material itself, an exiting and non-absorbed portion of the attenuated given microwave field energy having passed through the solid portion of the susceptor material itself acting on a target in the specimen vessel when the specimen vessel is placed within a reaction chamber of a microwave unit, wherein the susceptor material is further configured to convert the absorbed microwave field energy into heat, thereby causing the solid portion to increase in temperature and thereby causing other substances in the vessel to heat up.

2. The apparatus according to claim 1, wherein the histological agent includes one of a fixing agent, a dehydrating agent, a clearing agent, an embedding agent, a de-embedding agent, and a staining agent.

3. The apparatus according to claim 2, further comprising the microwave unit including the reaction chamber, and further comprising a processing station in the reaction chamber of the microwave unit.

4. The apparatus according to claim 1, wherein the vessel includes at least one of a container, a plate, an open fluid holder, a closed fluid holder, and a conduit.

5. The apparatus according to claim 1, further comprising the microwave unit including the reaction chamber.

6. The apparatus according to claim 5, further comprising a processing station in the reaction chamber of the microwave unit.

7. The apparatus according to claim 1, wherein the histological agent includes an embedding agent.

8. The apparatus according to claim 6, wherein the histological agent includes paraffin.

9. The apparatus according to claim 6, wherein the susceptor material comprises metal capable of absorbing at least one of an electric and a magnetic portion of microwave field energy produced in the microwave chamber to convert that energy to heat.

10. The apparatus according to claim 1, wherein the susceptor material includes metal, and wherein the metal includes metal flakes each having a face and a thickness, and each having an aspect ratio of at least about ten (10), where the aspect ratio for a given metal flake is defined as a ratio of a largest dimension of the face of the given metal flake to the thickness of the metal flake.

11. The apparatus according to claim 10, wherein the metal flakes include aluminum and have an aspect ratio of ten to three hundred, and wherein each flake has a largest face dimension of 1 to 48 micrometers and a thickness of 0.1 to 0.5 micrometers.

12. The apparatus according to claim 9, wherein the susceptor material includes a metal layer applied to a substrate.

13. The apparatus according to claim 12, wherein the metal layer is coated with a protective polyester layer.

14. The apparatus according to claim 1, wherein the microwave susceptor is in direct or indirect contact with the histological agent in the specimen vessel.

15. The apparatus according to claim 6, wherein the microwave susceptor is in direct or indirect contact with the histological agent in the specimen vessel.

16. The apparatus according to claim 1, wherein the microwave susceptor is embedded within a structure of the specimen vessel.

17. The apparatus according to claim 6, wherein the microwave susceptor structure is embedded within a structure of the specimen vessel.

18. The apparatus according to claim 6, further comprising a programmable control mechanism, a substance transfer mechanism, and another treatment mechanism, the programmable control mechanism being programmed to automatically process tissue, including acts of fixation, dehydration, clearing, and infiltration, all in the process station in the reaction chamber, without the need to move or remove the specimen vessel during or in between the fixation, dehydration, clearing, and infiltration acts.

19. The apparatus according to claim 18, wherein the programmable control mechanism includes a microprocessor.

20. A method for heating materials, the method comprising:

providing one or more histological agents in a vessel, all of the one or more histological agents in the vessel consisting essentially of a non-polar histological substance or non-polar histological substances;

providing the vessel in a microwave chamber;

providing a microwave susceptor in, near, or integral to the vessel, the microwave susceptor comprising a susceptor material configured and positioned in relation to the non-polar histological agent so as to both absorb and attenuate given microwave field energy at a solid portion of the susceptor material as a result of the given microwave field energy passing through the solid portion of the susceptor material itself, an exiting and non-absorbed portion of the attenuated given microwave field energy having passed through the solid portion of the susceptor material itself acting on a target when the specimen vessel is placed within a reaction chamber of a microwave unit, wherein the susceptor material is further configured to convert the absorbed microwave field energy into heat, thereby causing the solid portion to increase in temperature and thereby causing other substances in the vessel to heat up; and heating the target by applying microwave energy to the microwave chamber while the microwave susceptor, the vessel, and the non-polar histological agent are in the microwave chamber.

21. The method according to claim 20, wherein the one or more non-polar histological agents include a non-polar embedding agent.

22. The apparatus according to claim 21, wherein the non-polar embedding agent includes a material including paraffin.

23. The apparatus according to claim 20, wherein the one or more non-polar histological agents include a non-polar clearing agent.

24. The apparatus according to claim 23, wherein the non-polar clearing agent includes isoparaffinics.

25. The apparatus according to claim 20, wherein the vessel includes at least one of a container, a plate, an open fluid holder, a closed fluid holder, and a conduit.

26. The method according to claim 20, wherein the susceptor material includes metal, and wherein the metal includes metal flakes each having a face and a thickness, and each having an aspect ratio of at least ten (10), where the aspect ratio for a given metal flake is defined as a ratio of a largest face dimension of the face of the given metal flake to the thickness of the metal flake.

27. The method according to claim 26, wherein the metal flakes include aluminum and each has a largest face dimension of 1 to 48 micrometers and a thickness of 0.1 to 0.5 micrometers.

28. The apparatus according to claim 1, wherein the target upon which the microwave field energy acts is specimen tissue.

29. The apparatus according to claim 1, wherein the target upon which the microwave field energy acts is paraffin.

30. The apparatus according to claim 1, wherein the target upon which the microwave field energy acts is a non-polar histological agent.

31. The apparatus according to claim 20, wherein the target upon which the microwave field energy acts is specimen tissue.

32. The apparatus according to claim 20, wherein the target upon which the microwave field energy acts is paraffin.

33. The apparatus according to claim 20, wherein the target upon which the microwave field energy acts is a non-polar histological agent.

* * * * *